US008508312B2

(12) United States Patent
Perottino et al.

(10) Patent No.: US 8,508,312 B2
(45) Date of Patent: Aug. 13, 2013

(54) OMT TYPE BROADBAND MULTIBAND TRANSMISSION-RECEPTION COUPLER-SEPARATOR FOR RF FREQUENCY TELECOMMUNICATIONS ANTENNAS

(75) Inventors: Paddy Perottino, Tournefeuille (FR); Philippe Lepeltier, Castanet (FR)

(73) Assignee: Thales, Neuilly sur Seine (FR)

( * ) Notice: Subject to any disclaimer, the term of this patent is extended or adjusted under 35 U.S.C. 154(b) by 596 days.

(21) Appl. No.: 12/676,507

(22) PCT Filed: Sep. 5, 2008

(86) PCT No.: PCT/EP2008/061753
§ 371 (c)(1), (2), (4) Date: Mar. 4, 2010

(87) PCT Pub. No.: WO2009/030737
PCT Pub. Date: Mar. 12, 2009

(65) Prior Publication Data

US 2010/0207702 A1 Aug. 19, 2010

(30) Foreign Application Priority Data

Sep. 7, 2007 (FR) ..... 07 06284

(51) Int. Cl.
*H01P 1/16* (2006.01)
*H01P 5/12* (2006.01)

(52) U.S. Cl.
USPC ..... 333/126; 333/21 R; 333/135; 333/137

(58) Field of Classification Search
USPC ..... 333/21 A, 21 R, 125, 126, 135, 137
See application file for complete search history.

(56) References Cited

U.S. PATENT DOCUMENTS

| | | | | |
|---|---|---|---|---|
| 4,847,574 | A | 7/1989 | Gauthier et al. | |
| 5,617,108 | A * | 4/1997 | Silinsky et al. | 343/786 |
| 5,784,033 | A * | 7/1998 | Boldissar, Jr. | 343/786 |
| 6,313,714 | B1 * | 11/2001 | Junker et al. | 333/125 |
| 6,657,516 | B1 * | 12/2003 | Junker et al. | 333/125 |
| 7,432,780 | B2 * | 10/2008 | Chan et al. | 333/127 |

FOREIGN PATENT DOCUMENTS

GB 2 194 859 A1 3/1988

OTHER PUBLICATIONS

Shashi Bhushan Sharma et al., "Multifrequency Waveguide Orthomode Transducer", IEEE Transactions on Microwave Theory and Techniques, Aug. 2005, pp. 2604-2609, vol. 53, No. 8, IEEE Service Center, Piscataway, NJ, USA.

* cited by examiner

*Primary Examiner* — Robert Pascal
*Assistant Examiner* — Kimberly Glenn
(74) *Attorney, Agent, or Firm* — Baker & Hostetler, LLP

(57) ABSTRACT

The present invention relates to a multiband transmit-receive coupler-separator with a very wide band of the OMT ("Ortho-Mode Transducer") type for microwave-frequency telecommunications antennae. This coupler comprises a port for propagating all of the frequencies, a body and a port for propagating high-frequency bands, these three portions being coaxial, and wide-band coupling slots for propagating the low-frequency bands made in the body and each associated with a waveguide, and it is characterized in that its body joining the two ports has a shape of revolution the profile of which changes according to a multipolynomial law, constantly decreasing from the port with the largest cross section to the port with the smallest cross section. This coupler can operate in order to couple and separate very wide bandwidths (the overall use of this coupler-separator being more than one octave), and two or four wide-band coupling slots are necessary for the propagation of linear and circular polarizations after recombination.

5 Claims, 4 Drawing Sheets

OMT TYPE BROADBAND MULTIBAND TRANSMISSION-RECEPTION COUPLER-SEPARATOR FOR RF FREQUENCY TELECOMMUNICATIONS ANTENNAS

CROSS-REFERENCE TO RELATED APPLICATIONS

This application is a National Stage of International patent application PCT/EP2008/061753, filed on Sep. 5, 2008, which claims priority to foreign French patent application No. FR 07 06284, filed on Sep. 7, 2007, the disclosures of which are hereby incorporated by reference in their entirety.

FIELD OF THE INVENTION

The present invention relates to a multiband transmit-receive coupler-separator with a very wide band of the OMT ("OrthoMode Transducer") type for microwave-frequency telecommunications antennae. Such a device may also be called a "multiplexer" or "multiplexing OMT". To simplify the description, this device will be simply called a "coupler".

BACKGROUND OF THE INVENTION

FIG. 1 gives a diagram of an OMT called a "linear polarization separator", which is made according to the microwave-frequency waveguide technology. This OMT, reference number 1, essentially comprises a first port 2 designed to be connected to a horn facing a microwave-frequency telecommunication antenna and two other ports 3, 4 designed to be connected to a transmitter or a receiver. This OMT operates only with linear polarizations. These three ports are coaxial. The port 3 corresponds to the horizontal polarization and the port 4 to the vertical polarization. The port 3 is rectangular and is connected to the port 2 by one or more waveguide segments 5 having dimensions that are mid-way between those of the ports 2 and 3. The port 4 is connected radially to the port 2 by two waveguide segments 6A, 6B placed symmetrically relative to the common axis of the three ports and each having approximately a "U" shape that is elongated and culminating in coupling slots that are diametrically opposed to each of the ports 2 and 3.

The coupler 7 of FIG. 2 is a "pyramid-shaped" OMT. It comprises essentially a central cavity with a parallelepipedal body of square section and a pyramid 8 placed at the bottom of this cavity. Ports 9 to 12 culminate facing the four lateral triangular surfaces of the pyramid of the parallelepipedal body. With such an OMT, the coupling of the electromagnetic waves between the central port with square section and the four ports can be wide-band. This range of operation can be affected or reduced with the use of a transition between the ports of circular section and the parallelepipedal body of the OMT promoting the propagation of the higher-order modes. Moreover, this coupler has no multiplexing function.

FIG. 3 shows a conventional OMT 13 with circular cross sections. It essentially comprises three successive coaxial waveguide segments 14, 15 and 16 that are generally cavities. The first guide 14 has the largest diameter and comprises two or four rectangular coupling slots like the slot 14A, the only one shown in the drawing, each associated with a port like the ports 14B shown in the drawing. Similarly, the segment 15, with a smaller diameter than that of the segment 14, comprises two or four coupling slots 15A each associated with a port 15B. Finally, the segment 16, with a smaller diameter than that of the segment 15, forms the port for propagating the highest frequency band, while the segment 14 couples the lowest frequencies and the segment 15 couples the frequencies of intermediate value. Such a coupler therefore allows multiband coupling, but the widths of these bands are small.

The coupler 17 of FIG. 4 is of the type that comprises a cavity 18 in the form of a rectangular parallelepiped extended by a parallelepipedal cavity with a square or rectangular cross section and a port 19 with a square or rectangular cross section and being coaxial with the axis of the cavity. The cavity 18 comprises, on each of its two (or four) lateral faces, a coupling slot 18A associated with a coupling port 18B. Such a coupler operates for a relatively wide frequency band, but the transition (not shown), serving as an interface to the connection of a horn of circular cross section, and situated between the cavity 18 with a square or rectangular cross section and the waveguides of circular cross section that are connected thereto, reduces its operating range because of the presence of higher-order modes, and notably of harmonics, interfering with the propagation of the payload signals.

FIG. 5 shows a diagram of an OMT 20 as known according to the U.S. Pat. No. 6,566,976. This OMT comprises a conical body 21 connecting a port 22 of circular cross section to a port 23 also of circular cross section and having a smaller diameter than that of the port 22. Coupling slots 21A associated with ports 21B are made on the conical body 21. Such an OMT makes it possible to propagate only narrow frequency bands.

SUMMARY OF THE INVENTION

The subject of the present invention is a multiband transmit-receive coupler with a very wide band of the OMT type for microwave-frequency telecommunications antennae, that can operate for a very wide bandwidth (more than one octave), for both linear and circular polarizations.

The coupler according to the invention comprises a port for propagating all of the frequencies, a body and a port for propagating high-frequency bands, these three portions being coaxial and all three having a circular cross section, coupling slots for propagating the low-frequency bands being made in the body and each associated with a waveguide, and it is characterized in that its body joining the two ports comprises at least one section comprising a coupling segment and a segment for blocking the low frequencies, that is to say the coupled frequencies, and has a shape of revolution the profile of which changes according to a multipolynomial law, constantly decreasing from the port with the largest cross section to the port with the smallest cross section, each coupling segment comprising two or four wide-band coupling slots.

The coupling slots allow, after recombination, operation in linear and circular polarizations. If they are two in number and diametrically opposed, it involves a single linear polarization, and if they are four in number and placed at 90° relative to the adjacent slots, it involves linear and circular polarizations. In the coupling regime, all of the coupled signals, give or take the losses induced by the coupler itself and by the type of treatment of the machined material (for example, a silver-based finish allows very good conductivity) are then retrieved.

The blocking segment also performs a matching function allowing the propagation of the high frequencies breadthwise, and it also helps the overall matching of the coupler (between the ports P1 and P2).

BRIEF DESCRIPTION OF THE DRAWINGS

The present invention will be better understood on reading the detailed description of an embodiment, taken as a non-limiting example and illustrated by the appended drawing, in which.

DETAILED DESCRIPTION

The present invention is described below with reference to three simple examples of couplers, but it is clearly understood that it is not limited to these examples and that the bodies of these couplers may have a large number of other profiles, these profiles being defined generally as changing according to a multipolynomial law, constantly decreasing from the port with the largest cross section to the port with the smallest cross section.

All the couplers complying with the invention described below comprise mainly the following elements: a first port P1 followed by a body and a second port P2, these three main elements all having a circular cross section and being coaxial. The internal diameter of the port P1 is greater than that of the port P2, while the internal diameter of the coupling segment is equal to that of the port P1 at their junction and decreases constantly between its junction with P1 and its junction with P2. The body comprises at least one section consisting of a coupling segment and of a segment for blocking frequencies relating to the coupling segment of the same assembly. The embodiments described here each comprise only one such section, but it is well understood that the invention is not limited to a single such section, and that the coupler of the invention comprises as many of such sections as there are intermediate frequency bands to be processed (in coupling and in separation). The profile of the blocking segment may comprise one or more portions with different laws of change. For each of these couplers, the port P1 propagates all of the payload bandwidths (representing the coupling of low sub-bands and high sub-bands) and is connected (in a manner not shown) to a horn propagating, in transmission and in reception, electromagnetic waves in association with a focusing system such as a microwave-frequency telecommunications antenna, while the port P2 only propagates high sub-bands and the coupling ports of the coupling segment propagate low sub-bands. The port P2 and the ports of the coupling segment are connected (in a manner not shown) to transmit-receive systems. The law of change of the longitudinal profile of each coupling segment is an essential element of the invention and will be described in detail below for each of the embodiments shown.

Note that the coupling segment can comprise only two or four coupling slots, because a different number would be purely and simply useless.

The examples of profiles of coupling segments described below are simple to produce by machining whether they are linear or defined by splines.

Figure 1:
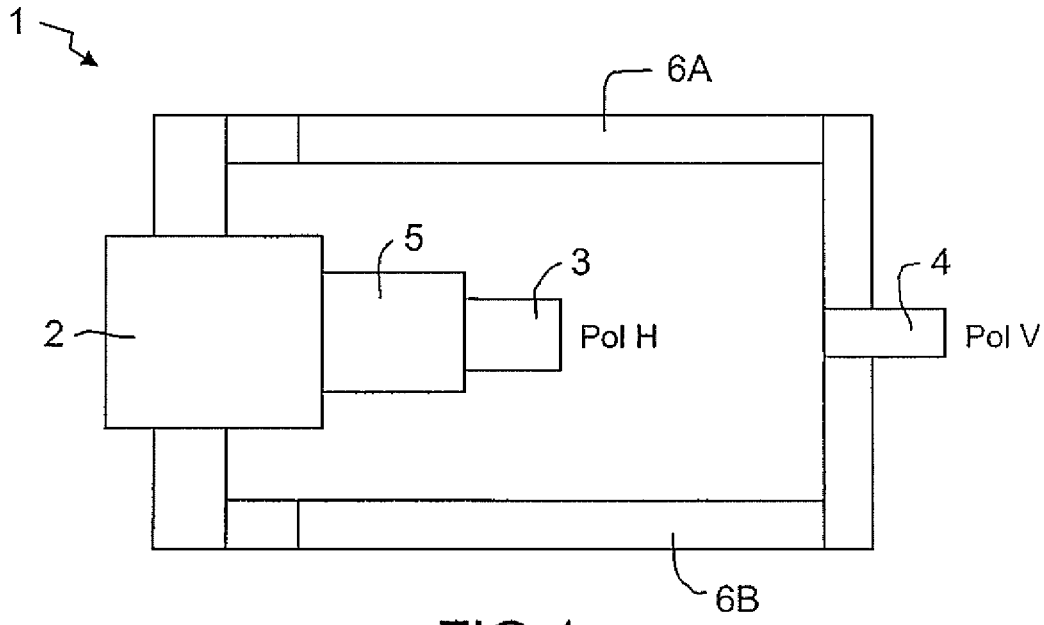
FIG.1 PRIOR ART
FIGS. 1 to 5, already described above, are simplified diagrams of known couplers.
Figure 2:
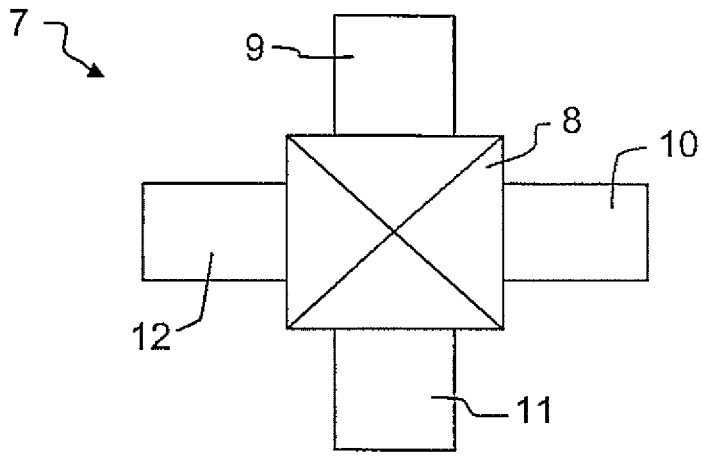
FIG.2 PRIOR ART
Figure 3:
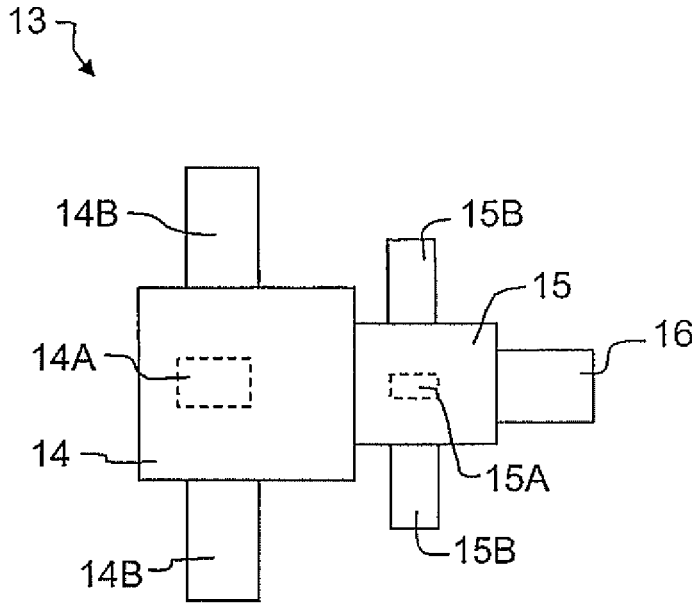
FIG.3 PRIOR ART
Figure 4:
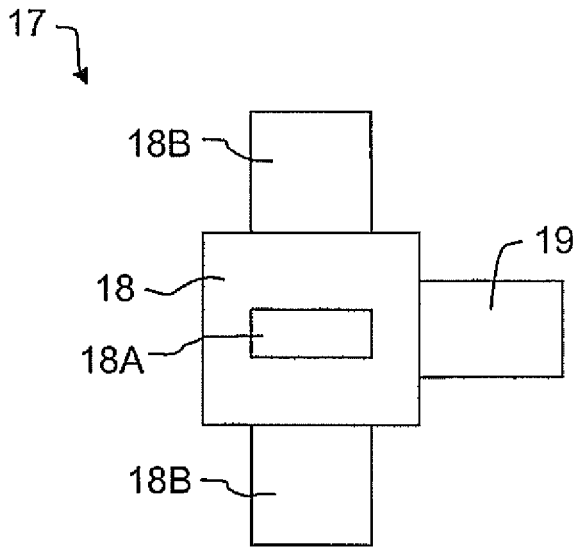
FIG.4 PRIOR ART
Figure 5:
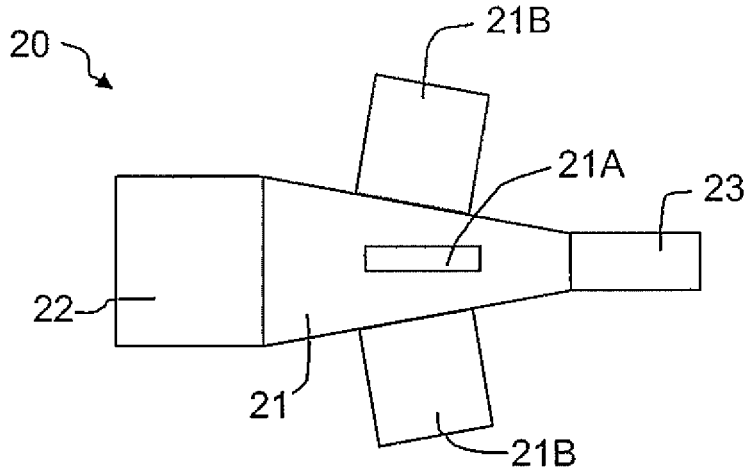
FIG.5 PRIOR ART
Figure 6:
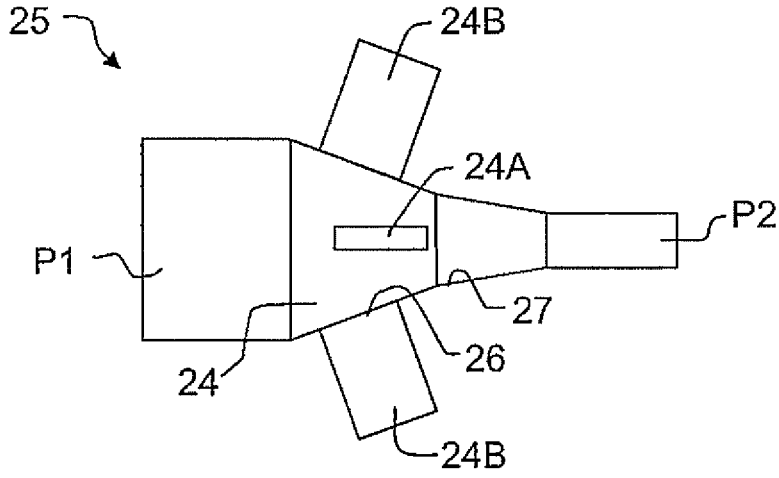
FIGS. 6 to 8 are simplified diagrams of three embodiments of a coupler according to the present invention.

The body 24 of the coupler 25 of FIG. 6 has a profile consisting of two consecutive linear portions 26 (determining the coupling segment) and 27 (determining the low-frequency blocking segment) with different slopes (these slopes must be considered in the plane of the figure, relative to the longitudinal axis of the coupler). It is well understood that this profile may comprise more than two portions with different slopes. In the example shown in the drawing, the slope of the portion 26 is greater than that of the portion 27, but the contrary is equally possible.

The ratios between the values of these slopes are different depending on the case in question, because they depend on the mission to be accomplished, namely: the percentages in relative band value of the sub-bands to be coupled and to be separated and of their frequency distance from one another. Each segment of the separator promotes the coupling of the low bands by having a slope with an angle θ1 (slope 26) of approximately 10 to 15° and the next segment of slope with an angle θ2 (slope 27) short-circuits (prevents) these same low bands from being propagated through the coupler. All of this also promotes a good matching (in terms of SWR, that is to say standing wave ratio) of the whole coupler for all the frequency bands to be propagated and separated. Wide-band rectangular coupling slots 24A are made in the body of the segment 24. These slots extend parallel to the longitudinal axis of the segment 24. In the present case, they are two or four in number. Two slots serve to couple at least one linear polarization and four slots serve to couple two linear polarizations and two circular polarizations. A recombination system (not shown) is necessary to restore them. Only one of these slots can be seen in the drawing. Each of the slots is associated with a rectangular-section waveguide 24B. Each coupling slot and associated waveguide is, in this instance, called a "coupling arm". The dimensions of the coupling slots are determined initially as those of a conventional rectangular waveguide in order to allow the propagation of the lowest frequencies to be coupled.

Preferably, for the embodiment of FIG. 6, as for all the embodiments according to the invention, there are, at the ends of each of the guides of the coupling arms, one or more conventional filtering cells (not shown) designed to eliminate possible frequency residues which might be outside the bandwidth to be coupled relative to the arms 24B and which must pass only longitudinally through the segment 24.

Figure 7:
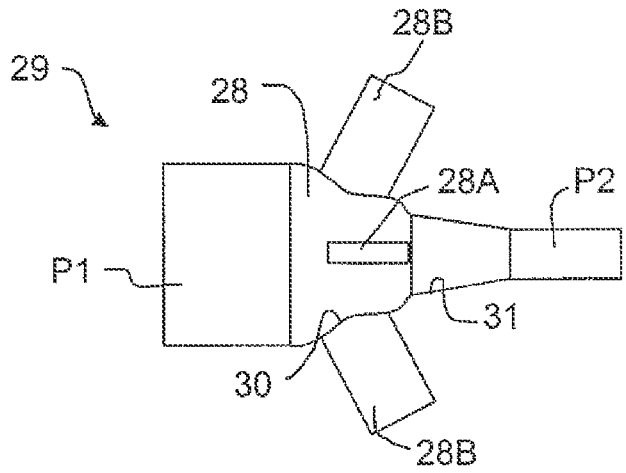

The profile of the coupling segment 28 of the coupler 29 of FIG. 7, considered from the port P1 to the port P2, consists of a spline 30 followed by a linear segment 31. The equation defining the spline 30 may have various forms provided that, as specified above, the diameter of the portion corresponding to the segment 28 decreases constantly from the port with the largest cross section to the port with the smallest cross section, or more precisely to the junction with the portion defined by the profile 31.

Figure 8:
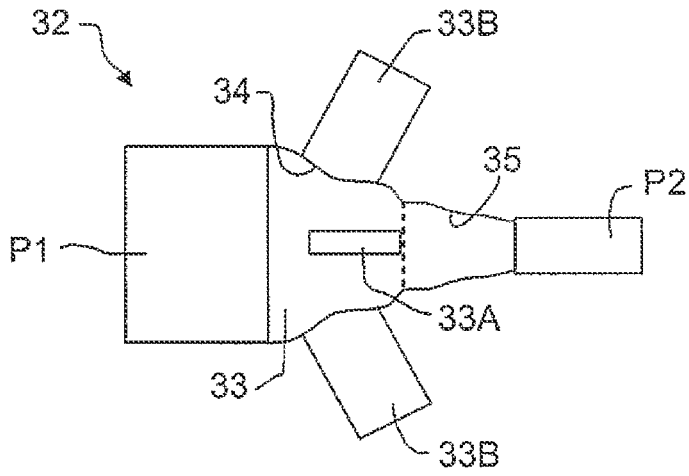

The coupler 32 of FIG. 8 comprises a coupling segment 33 the profile of which consists of two different successive splines 34, 35 each satisfying the same conditions as the spline 30 of FIG. 7. It is well understood that the profile of the coupling segment of the coupler of the invention may comprise more than two splines. The number of splines arises from the sizes of the bandwidths to be coupled (percentage of relative band), the number of bandwidths to be coupled and their frequency distance relative to one another. The possibility of mechanically producing the coupler may also limit this number of splines: a compromise will then be necessary. As an example, a square sine has been used to define the spline 35 in a coupler produced in order to couple the L band and to separate the C and Ku bands. This spline defined a short-circuit zone promoting the coupling of the low bands (L) and a good matching of the higher bands (C and Ku) being propagated through the coupler. The spline 34 performing the coupling was a polynomial of order 1 (linear profile).

According to a nonlimiting exemplary embodiment, the coupler of the invention processes the wide sub-bands Ku and Ka in both transmit and receive mode (the coupling and separation function of the coupler), whether it be in linear polarization or in circular polarization, which gives in total four sub-bands as follows. In the Ku band, the band of frequencies transmitted extends from 10.95 to 12.75 GHz and the band of frequencies received extends from 13.75 to 14.5 GHz. In the Ka band, the band of frequencies transmitted extends from 17.7 to 20.2 GHz and the band of frequencies received extends from 27.5 to 30 GHz. Since the smallest known waveguide is the C890 (radius=1.194 mm), the smallest couplers can be produced by electroplating or electroforming if conventional machining limits the production thereof. The complexity of the polynomial law of the segments must be chosen so as to take into account the requirements of the specifications while not overconstraining the possibility of production. Such a coupler may therefore be qualified as "very wide band", since the total band of frequencies covered (from 10.95 to 30 GHz) extends over more than one octave. In this example, the signals of the Ka band have circular polarization (right and left in transmit and receive mode), and those of the Ku band have linear polarization (horizontally and vertically orthogonal in transmit and receive mode). The whole of the Ku band (transmit and receive) passes through the four coupling arms of the coupling body and represents 27.9% of coupled relative band, while the Ka band passing through the coupler represents 51.6% of separated relative band. The relative band percentage $P_{BR}$ is defined as follows:

$$P_{BR} = \frac{F\max - F\min}{Fmoy},$$

which gives, for the Ku band:

$$P_{BR} = \frac{F\max - F\min}{Fmoy} = \frac{14.5\ \text{GHz} - 10.95\ \text{GHz}}{12.725\ \text{GHz}} \approx 27.9\%$$

The distance between the low band(s) to be coupled and the high band(s) to be propagated through the coupler-separator (in this instance from 14.5 to 17.7 GHz, that is to say the interband between Ku and Ka) indicates whether the coupler can be produced. This frequency distance must not be too small, otherwise there is a risk of also coupling the beginning of the highest bands. The use of a selective filter (a microwave-frequency iris filter of defined thickness comprising a recess in the form of a cross), placed between the coupling segment and the blocking segment or just after the blocking segment, may be helpful if the bandwidths to be coupled and separated are very close. This coupler makes it possible to use only one very wide-band antenna for the transmission (transmit and receive) of the four sub-bands.

The invention claimed is:

1. A multiband transmit-receive coupler-separator with very wide band of an orthomode transducer (OMT) coupler type for microwave-frequency telecommunications antennae, comprising:

a first port for propagating all of frequencies;

a body; and a second port for propagating high-frequency bands, wherein the first port, the body and the second port being coaxial and having a circular cross section, and a plurality of coupling slots for propagating a plurality of low-frequency bands made in the body and each of the plurality of low-frequency bands is associated with a waveguide, wherein the body joining the first and second ports comprises at least one section comprising a coupling segment and a segment for blocking coupled frequencies of the coupling segment, and has a shape of revolution with a profile of which changes according to a multipolynomial law, constantly decreasing from a port with largest cross section to a port with smallest cross section, each coupling segment comprising two or four wide-band coupling slots.

2. The coupler as claimed in claim 1, wherein the profile comprises at least two linear portions with different slopes relative to a common axis of the first and second ports and the body.

3. The coupler as claimed in claim 1, wherein the profile comprises at least one spline followed by a linear segment.

4. The coupler as claimed in claim 1, wherein the profile comprises at least two different successive splines.

5. The coupler as claimed in claim 1, wherein the profile comprises a cascade of several composite assemblies each with a linear coupling segment or spline with two or four of the plurality of coupling slots followed by a linear segment or spline with no coupling slot.

* * * * *